United States Patent [19]

King

[11] 4,208,136

[45] Jun. 17, 1980

[54] STATIC MIXING APPARATUS

[75] Inventor: Leonard T. King, Long Beach, Calif.

[73] Assignee: Komax Systems, Inc., Long Beach, Calif.

[21] Appl. No.: 965,283

[22] Filed: Dec. 1, 1978

[51] Int. Cl.[2] ..... B01F 15/00

[52] U.S. Cl. ..... 366/338; 138/42

[58] Field of Search ..... 366/336–341; 61/14, 15; 285/188; 425/131, 198, 204; 138/37, 39, 42

[56] References Cited

U.S. PATENT DOCUMENTS

| | | | |
|---|---|---|---|
| 3,404,869 | 10/1968 | Harder | 366/338 |
| 3,583,678 | 6/1971 | Harder | 366/340 |
| 3,590,855 | 7/1971 | Woollen et al. | 138/111 X |
| 3,635,444 | 1/1972 | Potter | 366/339 |
| 3,643,927 | 2/1972 | Crouch | 366/337 |
| 3,652,061 | 3/1972 | Chisholm | 366/337 |
| 3,664,638 | 5/1972 | Grout et al. | 366/338 |
| 3,704,006 | 11/1972 | Grout | 210/63 R |
| 3,751,009 | 8/1973 | Archer | 366/337 |
| 3,949,970 | 4/1976 | ter Braak | 366/79 |
| 3,977,657 | 8/1976 | Shearer et al. | 366/341 |
| 4,034,965 | 7/1977 | King | 366/336 |
| 4,040,256 | 8/1977 | Bosche et al. | 61/15 |
| 4,050,676 | 9/1977 | Morishima | 366/339 |

*Primary Examiner*—Leonard D. Christian

*Attorney, Agent, or Firm*—Limbach, Limbach & Sutton

[57] ABSTRACT

An apparatus for mixing materials having no moving parts in which a plurality of mixing elements are arranged in parallel around the inner periphery of a conduit. The elements are held in place around the periphery by a support member which is positioned along the longitudinal axis of the conduit. Substantial stream division of material flowing in the mixer conduit is achieved over a short distance with a minimum pressure drop. Each of the plurality of elements initially imparts a rotational vector to portions of the material stream.

10 Claims, 6 Drawing Figures

STATIC MIXING APPARATUS

FIELD OF INVENTION

This invention relates generally to static mixers and more particularly it relates to a static mixer with a plurality of its mixing elements all nested in parallel about the inner periphery of the mixer conduit.

DESCRIPTION OF THE PRIOR ART

Mixing is a term applied to actions which reduce non-uniformities of materials in bulk. Such materials can be liquids, solids or gases and the non-uniformities in such materials can occur in various properties such as color, density, temperature, etc. The quality of mixing can be described by using two characteristics—scale and intensity. The scale of a mixture is the average distance between centers of maximum difference in a given property of the mixture and intensity is the variation in a given property of the mixture.

Means for mixing two or more of these materials such as two or more fluid streams can include a simple device having no moving parts such as a tube or pipe filled with chains, rocks or ball bearings. Such devices have been used in the past and have been patented. The idea behind these arrangements is that if a sufficiently large number of alternate paths are presented to the material flow, the process of division and recombination of the material streams will eventually produce adequate mixing of the two streams. A major disadvantage, however, to this approach is that such arrangements produce a high pressure drop due to the extended lengths of the tube or conduit which is necessary for employing a sufficient number of devices in the flow path, making the approach impractical. This is particularly true with laminar flows where there is no turbulence in the flow to assist in blending the viscous materials.

Many alternate approaches have been proposed and tested with varying degrees of success. These include arrangements of baffles in the tube or pipe having a relatively open structure that divide and recombine fluid streams in a systematic fashion so as to minimize pressure drop. A common type of such a device is known as a two-by-two mixer with two input streams that are each divided in two by the first element to produce four streams, these four streams are then divided by the second element to produce eight streams, and so on. Elements in such an arrangement are usually arranged in a left, right, left, right or series fashion. In such a case, each element has a typical length to diameter ration in the range of 0.9-2.0 to 1. With such devices where their elements are arranged in series, the scale of the mixture is often reduced well below that of the conduit diameter using only a few elements. Satisfactory improvement of the intensity of the mixture, however, frequently requires more elements resulting in a much longer mixture conduit. Since typically twelve or more elements are required in series to produce adequate mixing (where the scale and intensity of the mixture are improved) under laminar flow conditions, the overall length of a complete tube or pipe mixer can become inconveniently long, and produce a high pressure drop in the mixing tube or conduit.

Several varieties of prior art mixing apparatuses are known and disclosed in the following U.S. Pat. Nos:

2,587,140
3,051,452
3,051,453
3,182,965
3,195,865
3,206,170
3,239,197
3,286,992
3,328,003
3,358,749
3,394,949
3,394,924
3,404,869
3,406,947
3,470,912
3,635,444
3,583,678
3,643,927
3,652,061
3,664,638
3,682,443
3,704,006
3,733,057
3,751,009
3,831,904
3,923,288
3,949,970
3,977,657
4,034,965

Also of interest is French Pat. No. 735,033 (1932). All of the above patents are herewith incorporated by reference.

Most prior art approaches typically involve expensive machining, molding, casting or other fabrication of the component mixer element coupled with some type of attachment between elements and a conduit and/or between elements within a conduit. The resulting cost and difficulty of manufacture results in a relatively expensive end product. Moreover, many of the prior art mixers provide less than complete mixing, particularly with respect to materials flowing along the walls of the conduit. This so-called "wall-smearing" is related to the parabolic velocity profile of a fluid having laminar flow in a pipe: the fluid velocity is small or zero along the wall surface.

SUMMARY OF THE INVENTION

In view of the problems outlined above in the prior art, particularly with respect to the long length conduit or pipe required, it is apparent that there is a need in the stationary material mixing art for an apparatus which would provide for adequate mixing of various viscous materials with a conduit of minimum length. Accordingly, I have invented a static mixing device which incorporates a plurality of mixing elements about the inner periphery of the mixing conduit to provide for a shorter mixing conduit or tube thereby resulting in a more adequate mixing of viscous materials. Specifically, my invention comprises a conduit with a number of mixing elements disposed about the inner periphery of the conduit wall and with one or more elements disposed about the center region formed by the peripheral elements. In practice, my invention allows improvements in mixture intensity with a much shorter conduit than would otherwise be required.

BRIEF DESCRIPTION OF THE DRAWINGS

The advantages and characteristic features of the subject invention will be in part apparent from the accompanying drawings, and in part pointed out in the following detailed description of the invention in which reference will be made to the accompanying drawings wherein like reference numerals designate corresponding parts, and wherein.

DETAILED DESCRIPTION OF THE PREFEREED EMBODIMENT

Figure 1:
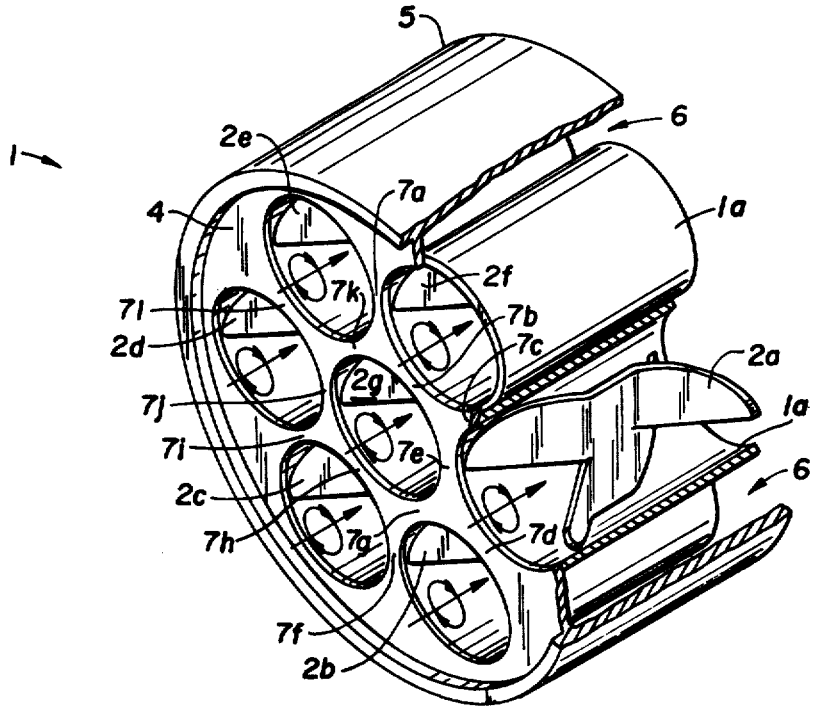
FIG. 1 is a partially schematic view of one embodiment of the invention incorporating a plurality of mixing elements about the conduit periphery.

Referring now to FIG. 1, wherein the stationary material mixing apparatus 1 is shown with several of its component mixing assemblies comprising portions 1*a* and mixing elements 2*a*, 2*b*, 2*c*, 2*d*, 2*e*, 2*f* and 2*g* all oriented in the same direction (see description of FIG. 2) as indicated by the arrows drawn on the various elements and held by support member 4 which is mounted in conduit 5 of apparatus 1. Conduit 5 has an internal chamber 6 which opens at the two ends of conduit 5. A longitudinal axis passes through the length of chamber 6. Elements 2*a*–2*f* are held by support member 4 in a position around the inner periphery of conduit 5 when member 4 along with elements 2*a*–2*f* is mounted in chamber 6 of conduit 5. Element 2*g* is positioned in the center region of member 4 and is surrounded by elements 2*a*–2*f*.

In view of the generally cylindrical configuration of chamber 6, the cylindrical coordinate system will be used throughout this specification and claims. As is well known, in the cylindrical coordinate system, a point is defined by l, r and $\theta$, where l is the longitudinal coordinate, r the radial coordinate with reference to the longitudinal axis and $\theta$ is the angular coordinate in a plane normal to the longitudinal axis.

Although the present invention is shown and described with reference to a generally cylindrical chamber 6, it is to be understood that the invention is applicable to other configurations including chambers having a rectangular cross-section. Moreover, the longitudinal axis of the chamber need not be a straight line, but may be curved due to the nature of the elements 2*a*–2*g*, as will become more apparent hereinafter.

Figure 2:
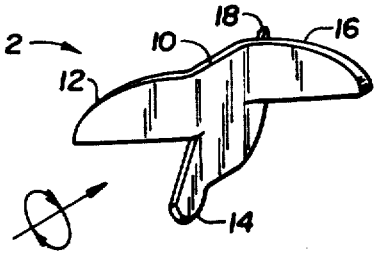
FIG. 2 is a perspective view of an arbitrarily designated "right-handed" mixing element.
Figure 4:
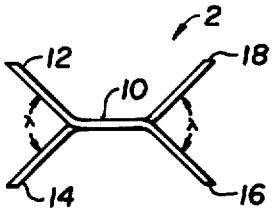
FIG. 4 is a side elevational view of the "right-hand" element of FIG. 2.

Elements 2*a*–2*g*, shown in greater detail in FIGS. 2 and 4, are arbitrarily designated as right-hand elements.

Referring now to FIG. 2, element 2, as taught in U.S. Pat. No. 3,923,288 and 4,034,965 issued to the present applicant, includes a central flat portion 10, first and second ears 12 and 14 rounded or otherwise configured at their outside periphery for a general fit into a support member 4 to be mounted in chamber 6, and are bent upward and downward from the flat portion 10. A second pair of ears 16 and 18 at the opposite side of flat portion 10, are bent downward and upward respectively. The outside peripheral edges of ears 16 and 18 are also rounded or otherwise configured for a general fit into a support member 4.

Element 2 may be formed from a single flat sheet by a punch press, for example. However, the use of element 2 in the present invention is not limited to any particular manner of fabrication, nor is the invention limited to providing element 2 as a unitary piece. For example, element 2 could be a plurality of pieces braised, soldered, welded or otherwise fastened together.

Elements 2*a*–2*g* in FIG. 1, similarly constructed as element 2 of FIG. 2 are mounted within sleeve portions 1*a* about a support member 4 which is then mounted in chamber 6 of conduit 5. When mounted in chamber 6, elements 2*a*–2*g* have their flat portions generally perpendicular to the longitudinal axis of chamber 6. Elements 2*a*–2*g* are all oriented in the same direction so that the flat portions of each element is parallel to the flat portion of the adjacent element. In the present embodiment of the invention, as described in FIG. 1, a sheer point is created between the fluid streams exiting from every two adjacent elements where the streams' tangent points meet. That is, sheer points 7*a*–7*l* are created between tangential points of the fluid streams exiting from elements 2*a*–2*g* in FIG. 1.

Figure 3:
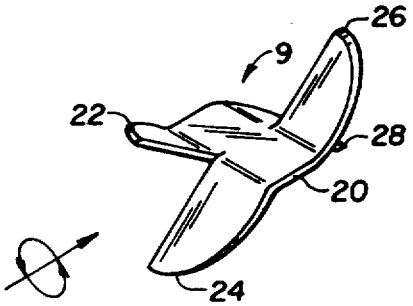
FIG. 3 is a perspective view of an arbitrarily designated "left-handed" mixing element.
Figure 5:
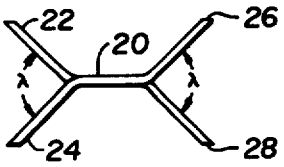
FIG. 5 is a side elevational view of the "left-hand" element of FIG. 3.

FIGS. 3 and 5 arbitrarily designated as a left-hand element 9 is similarly constructed as element 2 illustrated in FIG. 2, having a central flat portion 20, a first pair of ears 22 and 24 and a second pair of ears 26 and 28.

The angle $\lambda$ between ears 12–14, 16–18, 22–24 and 26–28, best seen in FIGS. 4 and 5, is preferably in the range of about 30° to 120° with an angle of 90° being shown as one example. Obviously, the extremes of 0° and 180° provide ultimate limits.

Figure 6:
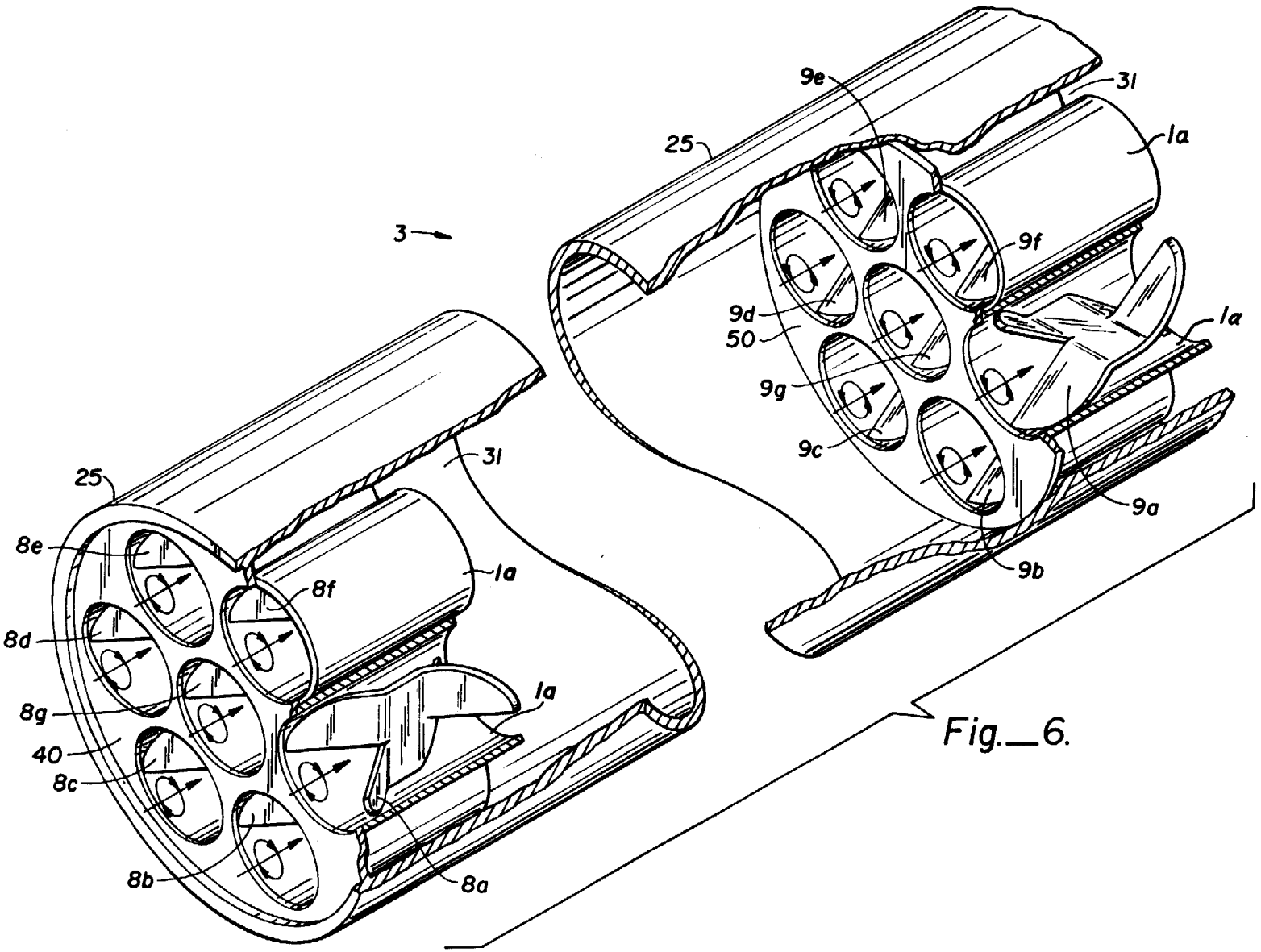
FIG. 6 is a partially schematic view of another embodiment of the invention incorporating two sets of a plurality of mixing elements about the conduit periphery.

FIG. 6 illustrates another embodiment of the present invention wherein a stationary material mixing apparatus 3 is shown with several of its component mixing assemblies comprising sleeve portion 1*a* and mixing elements 8*a*–8*g* all oriented in the same direction as indicated by the arrows drawn on the various elements held by a support member 40 which is mounted in conduit 25 of apparatus 3. Conduit 25 has an internal chamber 31 which opens at two ends of conduit 25. A longitudinal axis passes through the length of chamber 31. A second series of component mixing elements 9*a*–9*g* are located in an upstream position from elements 8*a*–8*g* and are held by a support member 50 and mounted in conduit 25 in a similar manner as is support member 40 of FIG. 1. Elements 9*a*–9*g* are all oriented in the same direction as indicated by the arrows drawn on elements 9*a*–9*g* and are oriented in a different direction from elements 8*a*–8*g* of support member 40.

When in operation, two or more materials to be mixed, such as fluids, are introduced into chamber 6 of conduit 5. These fluids pass along the longitudinal axis of chamber 6 moving longitudinally where they eventually are passed into contact with elements 2*a*–2*g* of member 4. When the fluids are passed in contact with elements 2*a*–2*g*, a clockwise velocity vector or rotational vector is imposed by ears 16 and 18 of element 2. The flat portion 10 transforms the rotational vector to a lateral or radial vector. Subsequent to the flat portion 10, ears 12 and 14 of element 2 impose a further clockwise velocity vector adding somewhat to the lateral or radial vector. It will also be noted that ears 16 and 18 impose a substantially inward directed radial velocity vector on materials moving longitudinally, whereas ears 12 and 14 of element 2 impose a substantially outward directed radial velocity vector. Fluid streams passing through elements 2a–2g are also divided in two by each of elements 2a–2g, resulting in twice as many fluid streams exiting the element as there were entering the element.

That is, in FIG. 1 where we have seven elements, 2a–2g, the two fluid streams entering these elements exit as fourteen fluid streams which have been divided twice by each of the elements. Upon exiting elements 2a–2g, the fourteen fluid streams contact each adjacent stream at their tangential points indicated by sheer points 7a–7l. This contact between the tangential points of the fluid streams result in adequate mixing of all the streams exiting from elements 2a–2g. Therefore, in the present FIG. 1 embodiment, the twelve sheer points (indicated by points 7a–7l) results in the rotating fluid which exits elements 2a–2g contacting the adjacent streams at these sheer points to result in adequate mixing of all the exiting fluid streams. This improvement is achieved when the length over diameter (L/D ratio of the mixing element is less than one compared to a two-by-two mixer and when the length over diameter ratio is greater than one for the conventional two-by-two mixer element.

Referring now to the embodiment illustrated in FIG. 6, when two or more fluids are introduced into conduit 25, they are passed along the longitudinal axis of chamber 31 to come into contact with elements 9a–9g of apparatus 3. Elements 9a–9g are all oriented in the same direction as was described with respect to element 9 in FIGS. 3 and 5. When the fluid streams come into contact with elements 9a–9g, ears 22–24 and 26–28 impose both a counter clockwise rotating velocity vector and a generally inward and outwardly radial vector upon the fluid respectively. While in contact with elements 9a–9g, the fluid streams are divided in two by each of elements 9a–9g, resulting in twice as many fluid streams exiting from elements 9a–9g as entered the elements.

Upon exiting elements 9a–9g, the fluid streams each contact their adjacent streams at the tangential points of the adjacent streams, resulting in a high degree of mixing of the exiting fluid streams from the elements. After the rotating fluid streams have exited elements 9a–9g and have recombined at their tangential point to result in a certain degree of mixing of the adjacent fluid streams, the fluid streams once again enter a second set of mixing elements 8a–8g all of which are oriented in the same direction, but in a different direction than elements 9a–9g.

Elements 8a–8g are oriented in a right-hand fashion as is best illustrated in FIGS. 2 and 4. When the recombined fluid stream comes into contact with elements 8a–8g, ears 12–14 and 16–18 impose a clockwise rotating velocity vector upon the fluid. Elements 8a–8g each divides the fluid streams into two streams, resulting in twice as many fluid streams exiting from the series of elements 8a–8g as entered elements 8a–8g. Then upon exiting elements 8a–8g, the fluid streams again recombine at their adjacent tangential points to result in adequate mixing of the divided fluid streams. Upon exiting elements 8a–8g, the divided fluid streams are once again recombined to result in even more adequate mixing of the fluid streams.

The above described series of dividing and recombining of the fluid streams introduced into conduit 25 results in a high degree of mixing of the fluid streams entering conduit 25. This degree of mixing will improve the intensity of the mixture in a conduit having a shorter than usual length, a feature which has long been lacking in the prior art apparatuses, including that which is the subject of U.S. Pat. No. 3,924,288 issued to the present applicant.

As a practical matter, it should be pointed out that before the fluids come into contact with elements 2a–2g in chamber 6 of FIG. 1 or elements 9a–9g in conduit 25 of FIG. 6, the fluids may be passed into contact with two or more conventional mixing elements to improve the scale of the mixture.

The invention has been illustrated and discussed above using seven mixing elements, but it should be understood that the design is not limited to seven elements but that any number of elements that will nest sufficiently as illustrated in the above embodiments will be suitable and operable in the present invention. The invention has further been discussed using fluids as the materials to be mixed, but it should be further understood that any material such as liquids, solids or gases can be properly mixed in the above disclosed embodiments of the present invention.

In view of the foregoing, modifications to the disclosed embodiments within the spirit of the invention will be apparent to those of ordinary skill in the art. The scope of the invention is therefore to be limited only by the appended claims.

What is claimed is:

1. A stationary material mixing apparatus comprising a conduit having a length, a longitudinal axis through said length opening on first and second ends of said conduit and including said longitudinal axis, a plurality of mixing assemblies, each having at least one mixing element disposed within a sleeve portion, said assemblies disposed about the inner periphery of a length of said conduit with each mixing element of each of said assemblies oriented in the same direction as the elements within the adjacent assemblies about said conduit length and with at least one of said elements of one of said assemblies oriented in the same direction as the other of said elements of said assemblies and with said one assembly disposed about the center region formed by the other of said plurality of assemblies disposed about the periphery of said chamber.

2. The combination of claim 1 wherein said plurality of mixing assemblies are each of a diameter which is no greater than one third the diameter of said chamber.

3. The combination of claim 1 further comprising a support member generally perpendicular to said axis and wherein each of said plurality of assemblies is held by said member.

4. The combination of claim 1 wherein each of said mixing elements of said mixing assemblies comprises a flat rectangular central portion having first and second sets of ears adjacent opposite sides of said central portion, said sets of ears including first and second ears bent upward and downward relative to the plane of said central portion.

5. A stationary material mixing apparatus comprising a conduit having an upstream and a downstream length, a longitudinal axis through said lengths, a chamber extending longitudinally through said lengths opening on said upstream and downstream lengths of said conduit and including said longitudinal axis, a first plurality of mixing elements disposed about the inner periphery of said upstream length of said conduit chamber with each of said elements oriented in the same direction as the other elements and with at least one of said first plurality oriented in the same direction as the other of said first plurality of elements disposed about the center region formed by the other of said first plurality of elements disposed about the periophery of said upstream length, at least a second plurality of mixing elements disposed about the inner periphery of said conduit chamber downstream of said first plurality of mixing elements, with each of said elements oriented in the same direction as the other of said elements in said second plurality of elements and with at least one of said second plurality oriented in the same direction as the other of said second plurality and disposed about the center region formed by the other of said second plurality of elements disposed about the periphery of said downstream length, and each of said elements of said second plurality is oriented in a different direction than are the elements of said first plurality.

6. The combination of claim 5 wherein said first and second plurality of mixing elements each comprise an odd number of such elements and said first and second plurality each has at least one of said first and second plurality respectively disposed about the inner periphery of said upstream and said downstream lengths respectively.

7. The combination of claim 5 wherein each of said elements of said first and said second plurality of elements is of a diameter which is no greater than one third the diameter of said chamber.

8. The combination of claim 5 further comprising first and second support members generally perpendicular to said axis wherein each of said first plurality of assemblies is held by said first member and each of said second plurality of elements is held by said second chamber.

9. The combination of claim 5 wherein each of said first and second pluralities of elements each comprises a flat rectangular central portion having first and second sets of ears adjacent opposite sides of said central portion, said sets of ears including first and second ears bent upward and downward relative to the plane of said central portion.

10. The combination of claim 5 including a plurality of sleeve portions wherein each of said elements of said first and second plurality of elements is disposed within a sleeve portion to form a mixing assembly such that said first plurality of elements, each within a sleeve portion, forms a first plurality of mixing assemblies and said second plurality of elements, each within a sleeve portion, forms a second plurality of mixing assemblies.

* * * * *